US008106833B2

(12) United States Patent
Chou

(10) Patent No.: US 8,106,833 B2
(45) Date of Patent: Jan. 31, 2012

(54) MINIATURE ANTENNA

(75) Inventor: Chih-Shen Chou, Jhunan Township, Miaoli County (TW)

(73) Assignee: Unictron Technologies Corporation, Hsin-Chu (TW)

( * ) Notice: Subject to any disclaimer, the term of this patent is extended or adjusted under 35 U.S.C. 154(b) by 408 days.

(21) Appl. No.: 12/435,428

(22) Filed: May 5, 2009

(65) Prior Publication Data

US 2010/0123630 A1 May 20, 2010

(30) Foreign Application Priority Data

Nov. 18, 2008 (TW) ..... 97144473 A

(51) Int. Cl.
*H01Q 1/38* (2006.01)

(52) U.S. Cl. ..... 343/700 MS; 343/702

(58) Field of Classification Search ..... 343/700 MS, 343/702, 829, 846
See application file for complete search history.

(56) References Cited

U.S. PATENT DOCUMENTS

| | | | | |
|---|---|---|---|---|
| 5,444,453 | A * | 8/1995 | Lalezari | 343/700 MS |
| 7,019,695 | B2 * | 3/2006 | Cohen | 343/700 MS |
| 7,161,540 | B1 * | 1/2007 | Liu | 343/700 MS |
| 2004/0027286 | A1 * | 2/2004 | Poilasne et al. | 343/700 MS |
| 2009/0079654 | A1 * | 3/2009 | Higaki et al. | 343/795 |
| 2009/0243937 | A1 * | 10/2009 | Humphrey et al. | 343/700 MS |

* cited by examiner

*Primary Examiner* — Tho G Phan
(74) *Attorney, Agent, or Firm* — Muncy, Geissler, Olds & Lowe, PLLC

(57) ABSTRACT

The present invention discloses a miniature antenna that has a simple structure, compact dimension and high efficiency. The miniature antenna is comprised of a dielectric element made of a dielectric material, having a first surface and a second surface opposite to the first surface, a first electrode layer being laid on the first surface, and a second electrode layer being laid on the second surface. The first electrode layer connected to a signal feeding line and the second electrode layer, connected to a ground plane, are partially overlapped to form a region that functions as a capacitor. Thereby, the miniature antenna can transmit and receive signals. The capacitance and resonant frequency of the miniature antenna can be adjusted via varying the pattern of the electrode layers, varying the thickness or permittivity of the dielectric element or via varying the size of the overlapping areas of the two electrode layers.

20 Claims, 9 Drawing Sheets

(a)

(b)

MINIATURE ANTENNA

BACKGROUND OF THE INVENTION

1. Field of the Invention

The present invention relates to an antenna structure, particularly to a structure of a miniature antenna applying to wireless communication products.

2. Description of the Related Art

Portable electronic products, such as mobile phones, WLAN (Wireless Local Area Network) products and GPS (Global Positioning System) products have flourished due to rapid advance of wireless communication technology. Because of market competition and consumers' desire for high-end products, the related manufacturers not only lay emphasis on electronic performance but also pay much attention to design appearance. Thus, the antennae, which are originally externally exposed, have gradually become internally designed. The concealed antennae, though arranged in a small confined space, still have to maintain a superior capability of signal receiving and transmitting.

Two of the commonly concealed antennae are the monopole antenna and the Planar Inverted F Antenna (PIFA). The monopole antenna is inexpensive with a simple structure. Length of the monopole antenna, however, cannot be effectively reduced due to the requirement of signal receiving efficiency. Therefore, use of the monopole antenna may impair the appearance of portable electronic products and has gradually become obsolete. PIFA, with a wider operation bandwidth, can be adapted to the form of a portable electronic device. Thus, PIFA is more widely used on the market. Both the monopole and the PIFA antennae are prone to be affected by the reactance effect generated due to the presence of dielectric materials or human body in the near-field region. This may result in frequency shift of the antenna. In other words, any object that is near to the antenna may affect its performance, causing a decrease of its efficiency of signal transmitting/receiving and an increase in noise.

Accordingly, the present invention proposes a miniature antenna characterized in a small size and a capability of confining induced current to the proximity of the antenna to overcome the conventional problems.

SUMMARY OF THE INVENTION

The primary objective of the present invention is to provide a miniature antenna, wherein electrode layers are partially overlapped to form a region that functions as a capacitor in series, thereby increase the capacitance of the antenna and decrease the dimension of the antenna.

Another objective of the present invention is to provide a miniature antenna, wherein the capacitance is modified via varying the overlapping regions of the electrode; thereby the resonant frequency can be easily adjusted.

A further objective of the present invention is to provide a miniature antenna having a simple structure and a small dimension, wherein induced current is confined to the proximity of the antenna thus effectively prevents the interference caused by dielectric objects nearby, especially human body, such as hand.

To achieve the abovementioned objectives, the present invention discloses a miniature antenna, which comprises a dielectric element, a first electrode layer and an opposing second electrode layer, wherein the dielectric element is made of a dielectric material and has a first surface and a second surface opposite to the first surface, wherein the first electrode layer and the second electrode layer are established on the first surface and the second surface, respectively. The first electrode and the second electrode layers are electrically conductive and are connected to a signal feeding line and to a ground plane, respectively. The first electrode layer and the second electrode layer are partially overlapped to form a region that functions as a capacitor; thereby the dimension of the antenna can be reduced. Further, the present invention can avoid the conventional problem of signal interference caused by induced current straying in the circuit board.

In the present invention, a carrier substrate may be used to carry a plurality of dielectric elements, with each dielectric element having a first electrode layer and a second electrode layer; thereby a small carrier substrate can be used to carry several miniature antennae. The resonant frequency of each antenna can be modified via varying the shape or design of the antenna, or by varying the permittivity of the dielectric element, thereby achieving multi-frequency reception.

Below, the embodiments of the present invention are described in detail in cooperation with the attached drawings, therefore the objectives, technical contents, characteristics and accomplishments can be easily understood.

BRIEF DESCRIPTION OF THE DRAWINGS

FIG. 5(*b*) is a schematic of a thick film process used for fabricating dielectric elements on the second electrode and the carrier substrate after the fabrication of second electrode layers for the plurality of the miniature antennas according to the second embodiment of the present invention.

FIG. 5(*c*) is a schematic of a thick film process used for fabricating first electrode layers on the dielectric elements and the carrier substrate for the plurality of the miniature antennas according to the second embodiment of the present invention.

FIG. 5(*d*) is a cross-sectioning view of the fabricated miniature antennas with the carrier substrate FIG. 6. is a perspective view showing a miniature antenna according to a third embodiment of the present invention;

FIG. 8(*b*) is a bottom view schematically showing the miniature antenna according to the fifth embodiment of the present invention;

FIG. 9(*b*) is a perspective bottom view schematically showing the miniature antenna shown in FIG. 8(*a*) and FIG. 8(*b*) when it is integrated with a circuit board.

DETAILED DESCRIPTION OF THE INVENTION

The present invention utilizes the capacitive effect of dielectric materials to fabricate a miniature antenna having a small dimension and capable of confining induced current to the proximity of the antenna, thereby avoids the interference arising from induction current straying in the circuit board, thus guarantee the efficiency of the antenna. In the miniature antenna of the present invention, two electrode layers are established on two opposite surfaces of a dielectric element, respectively. The electrode layers are partially overlapped to form a region that functions as a capacitor for increasing the capacitance of the antenna and decreasing the dimension of antenna.

Figure 1:
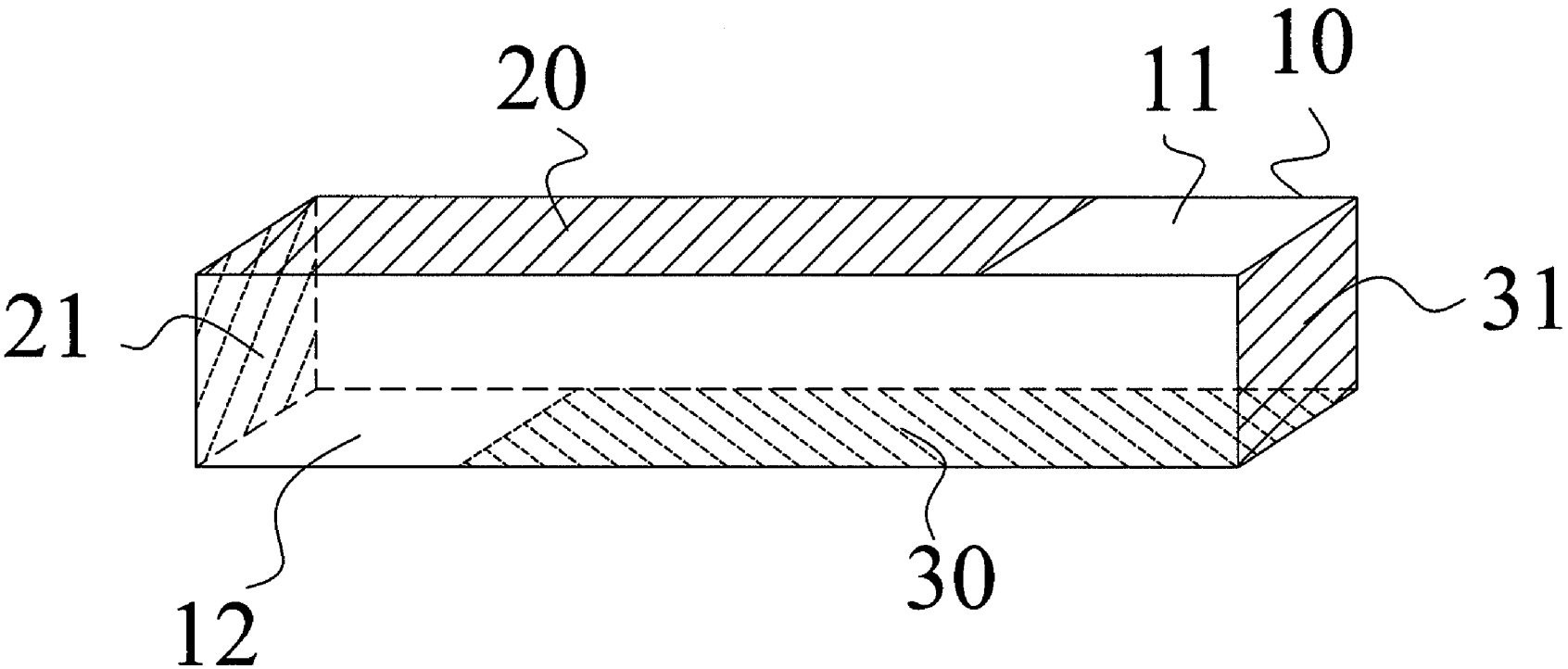
FIG. 1 is a perspective view of a miniature antenna according to a first embodiment of the present invention.
Figure 2:
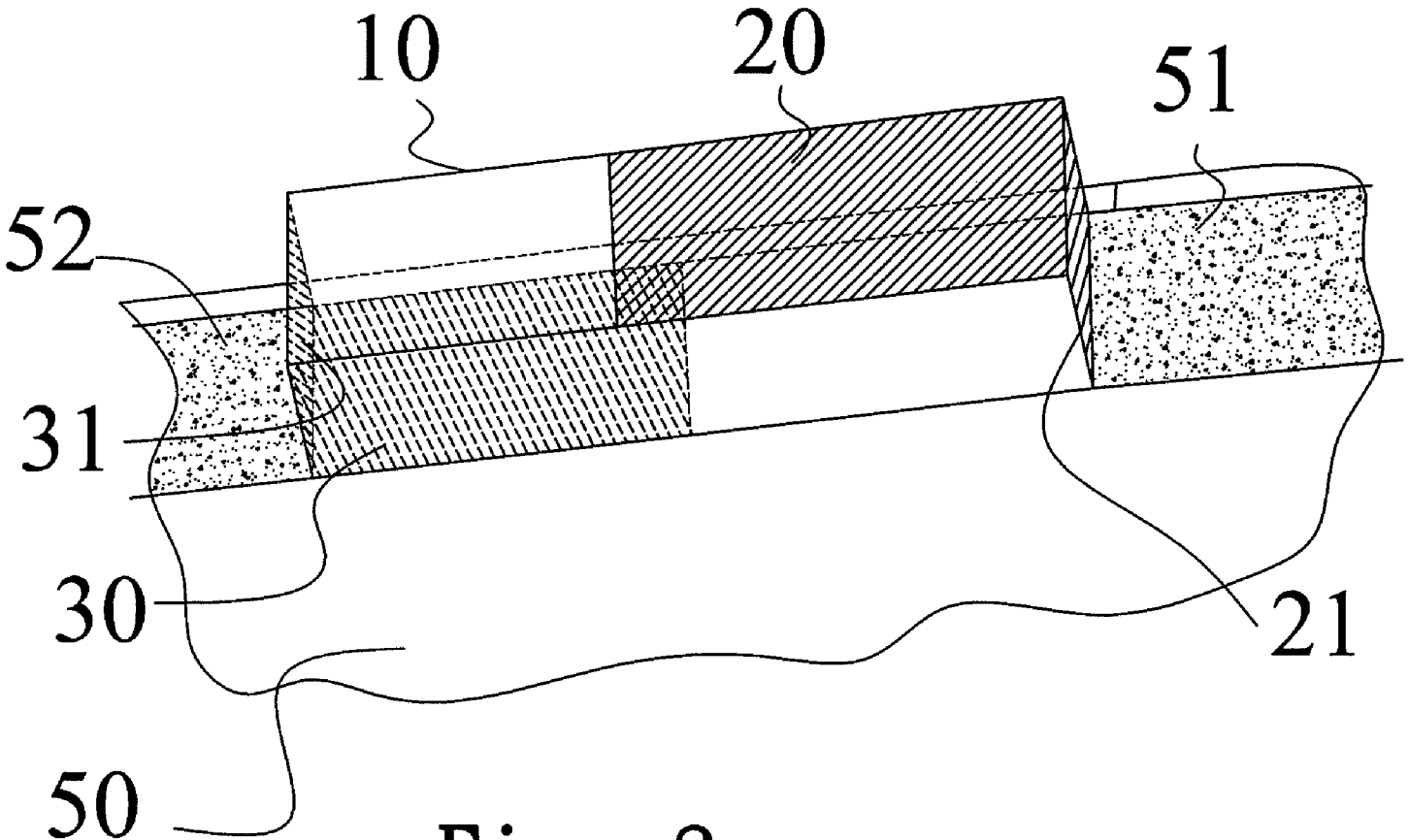
FIG. 2 is a perspective view illustrating one application of the miniature antenna shown in FIG. 1 according to the first embodiment of the present invention.
Figure 3:
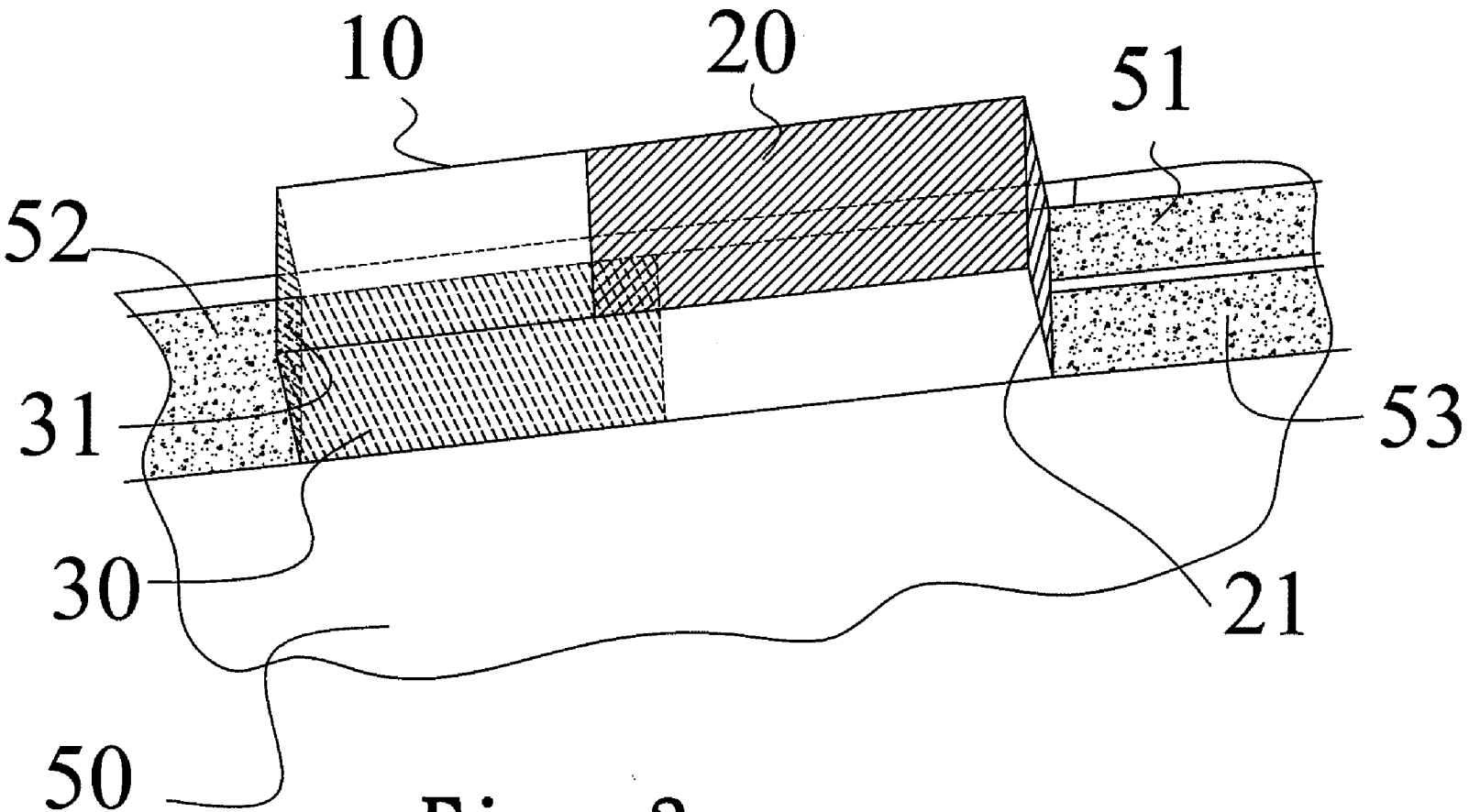
FIG. 3 is a perspective view of another application of the miniature antenna shown in FIG. 1 according to the first embodiment of the present invention.
Figure 4:
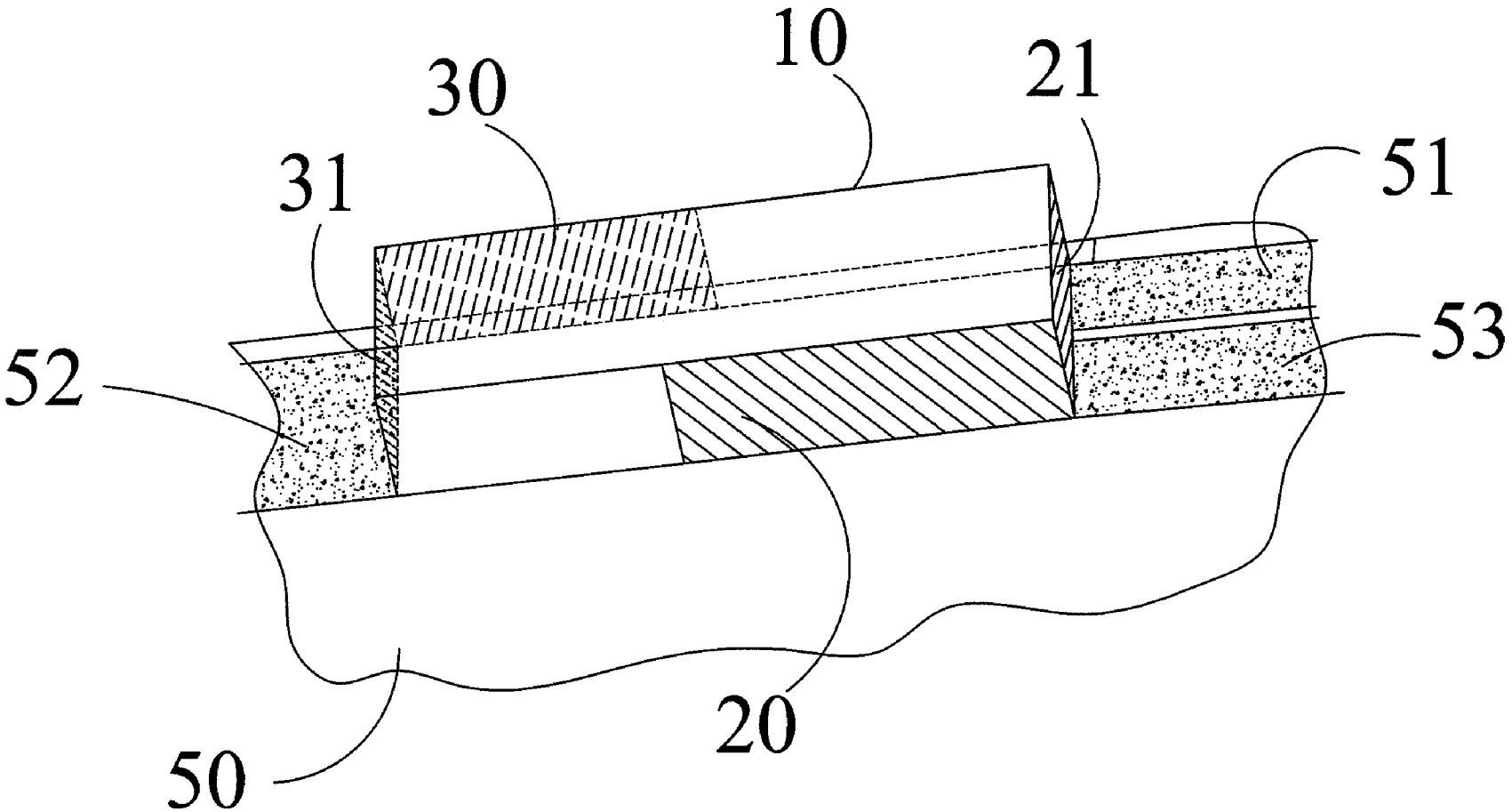
FIG. 4 is a perspective view of yet another application of the miniature antenna shown in FIG. 1 according to the first embodiment of the present invention.

FIG. 1 is a perspective view of a miniature antenna according to a first embodiment of the present invention. In the first embodiment, the miniature antenna comprises a dielectric element 10, a first electrode layer 20 and a second electrode layer 30. The dielectric element 10 is fabricated with a dielectric material for obtaining a required capacitance. The dielectric material is a ceramic material, a glass material, a magnetic material, a polymeric material, or a composite of the abovementioned materials. The dielectric element 10 is a cuboid and has a first surface 11 and a second surface 12 opposite to the first surface 11. The first electrode layer 20 and the second electrode layer 30 are made of a metal (such as gold, silver or copper) or an electrically conductive non-metallic material. The first electrode layer 20 and the second electrode layer 30 are fabricated on the first surface 11 and on the second surface 12, respectively. The first electrode layer 20 and the second electrode layer 30 are partially overlapped. The region between the overlapping areas of the electrodes functions as a capacitor that increases the capacitance of the miniature antenna. The first electrode layer 20 and the second electrode layer 30 each extends to one of two opposite end surfaces of the dielectric element 10 to form a first terminal electrode 21 and a second terminal electrode 31, as illustrated in FIG. 1. When the miniature antenna is integrated with a circuit board 50 as shown in FIG. 2, the first terminal electrode 21 of the first electrode layer 20 is connected with a signal feeding line 51, and the second terminal electrode 31 of the second electrode layer 30 is connected with a ground plane 52. Thereby, the miniature antenna of the present invention can receive and transmit signals. In practical application, the positions where the first terminal electrode 21 and the second terminal electrode 31 are disposed depend on the requirement of the portable electronic product. In FIG. 3, the first terminal electrode 21 of the first electrode layer 20 is connected to a ground plane 53 of the circuit board 50 in addition to the signal feeding line 51 of the circuit board 50; thereby the resonant frequency of the antenna can be lowered. In FIG. 4, the miniature antenna is integrated with the circuit board under a different configuration. The miniature antenna in FIG. 4 is capable of transmitting and receiving signal with the first terminal electrode 21 of the first electrode layer 20 connected to a ground plane 53 of the circuit board 50 in addition to the signal feeding line 51 of the circuit board 50 and its second terminal electrode 31 of the second electrode layer 30 connected with a ground plane 52. Thus, this antenna positioning variation is within the spirit of the present invention and should also be included within the scope.

Figure 5:
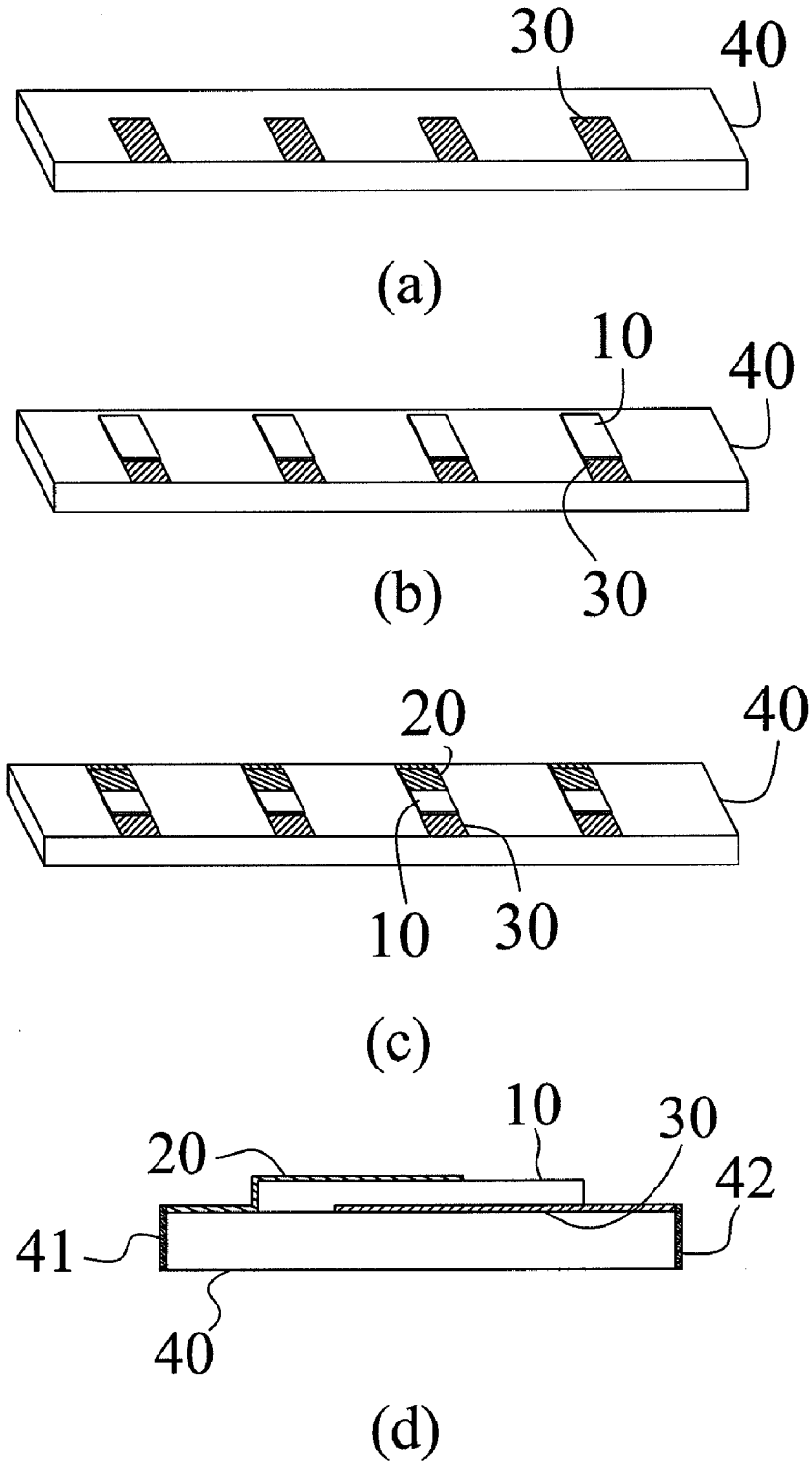
FIG. 5(*a*) is a schematic of a thick film process used for fabricating second electrode layers on a carrier substrate for a plurality of the miniature antennas according to a second embodiment of the present invention.

There are various means to realize the antenna structure disclosed in the present invention, and the present invention does not limit the means to realize the present invention. Further, any structure similar to the structure disclosed in the present invention and having equivalent functions should be also included within the scope of the present invention. FIG. 5(*a*) to FIG. 5(*d*) illustrates schematically a thick film process used to realize a plurality of miniature antennas according to a second embodiment of the present invention. In FIG. 5(*a*), a thick film process is used to fabricate a plurality of second electrode layers 30 on a carrier substrate 40. The carrier substrate 40 is made of a ceramic material, a glass material, a polymeric material, or a combination of the abovementioned materials. In FIG. 5(*b*), a thick film process is used to fabricate dielectric elements 10 on the second electrode layers 30 and the carrier substrate 40. In FIG. 5(*c*), a thick film process is used to fabricate a plurality of first electrode layers 20 on the carrier substrate 40 and the dielectric elements 10. FIG. 5(*d*) is a cross-sectioning view schematically showing the miniature antenna fabricated according to the procedures described above. The first electrode layer 20 and the second electrode layer 30 fabricated on the top and on the bottom surfaces of each dielectric element 10 respectively are partially overlapped. The abovementioned process is simple and is capable of fabricating large number of antennae simultaneously on the carrier substrate 40. After separating each antenna, two terminal electrodes 41 and 42 can be formed on two end surfaces of the carrier substrate 40; thereby making easy connection of the antenna to the signal feeding line 51 and the ground plane 52 of the circuit board 50. The method to realize the antenna structure of the present invention is not limited to the abovementioned thick film process. A sputtering technology or an evaporation deposition technology can be used to fabricate the dielectric element and the two electrode layers. Antenna structure as shown in FIG. 5(*d*) can be also obtained via sequentially adhering dielectric material films and electrically conductive material films onto the carrier substrate 40. Alternatively, a combination of the thin film method, the thick film method and the adhesion method may also be used to fabricate the antenna structure. Therefore, the antenna structure of the present invention can be easily realized with the abovementioned methods or the variations of the abovementioned methods.

Figure 6:
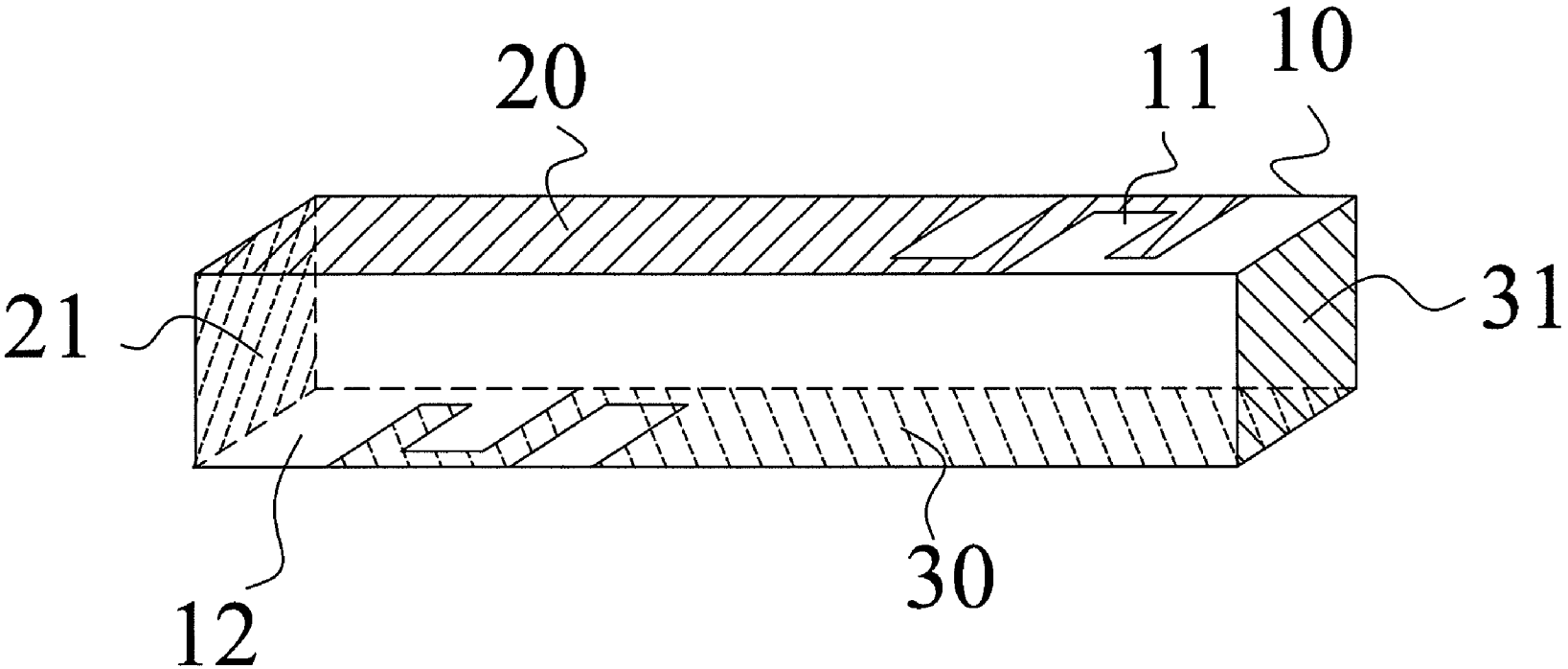

In the present invention, the resonant frequency can be easily adjusted via varying the capacitance of the antenna. In other words, the antenna can receive different frequencies via varying the shape and design of the antenna or via varying the dielectric constant of the dielectric element 10. Refer to FIG. 6 for a third embodiment of the present invention. A portion of the first electrode layer 20 and a portion of the second electrode layer 30 are fabricated to have a serpentine shape, thereby increase the length of the first electrode layer 20 and the second electrode layer 30. Thus the receiving frequency of the antenna can be varied via varying the capacitance or the length of the electrodes of the antenna.

Figure 7:
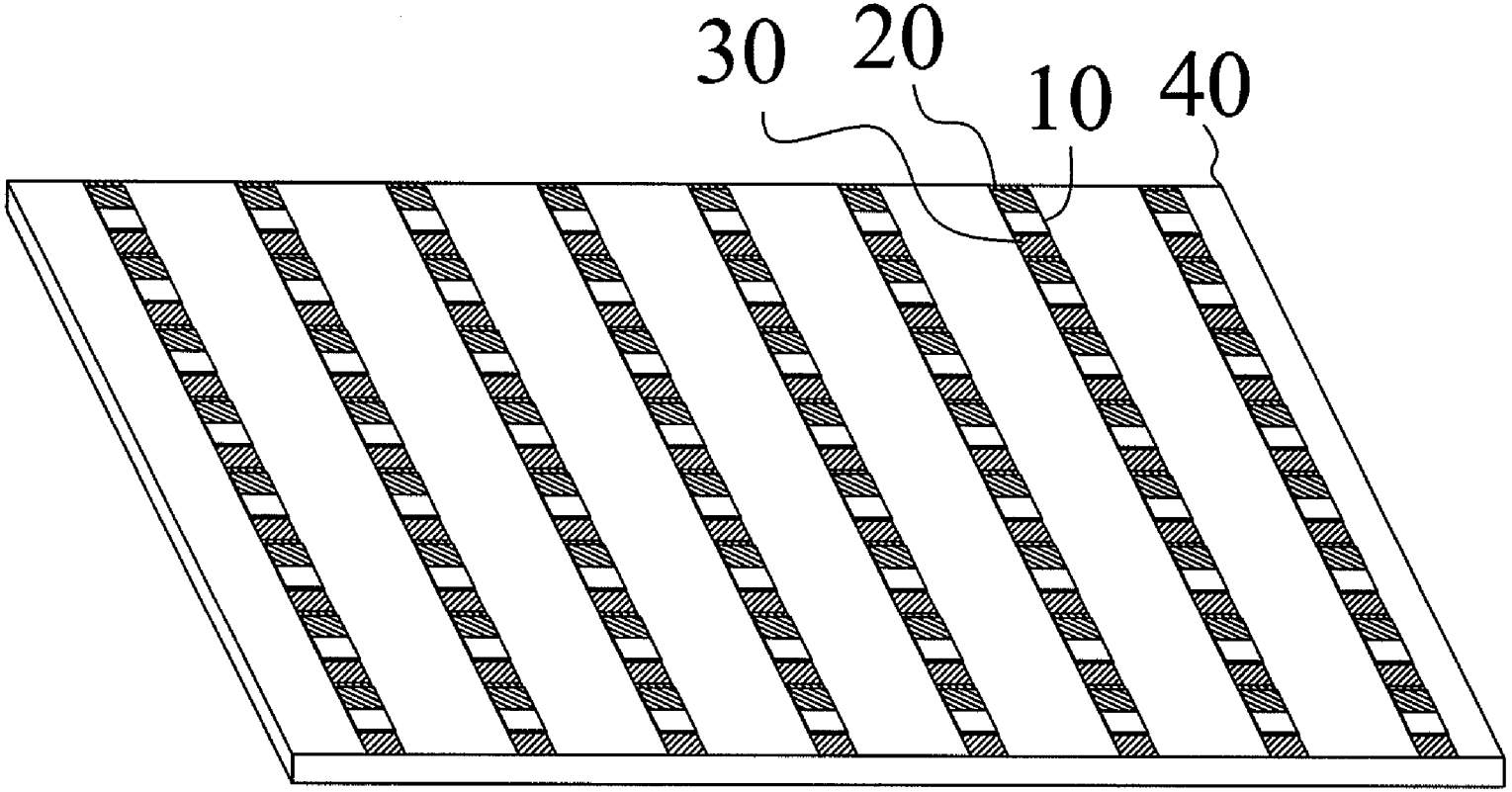
FIG. 7 is a schematic of a plurality of miniature antennae on a carrier substrate according to a fourth embodiment of the present invention.

Based on the abovementioned principles and fabrication processes, arrays of antennae, as shown in FIG. 7 for a fourth embodiment of the present invention can be mass-produced simultaneously on the carrier substrate 40. These arrays of antennae on carrier substrate 40 can be cut into individual miniature antenna with single operating frequency (similar to case shown in FIG. 5(*d*)). Alternatively, several miniature antennae, each having different operating frequency via varying its shape, design or dielectric element permittivity, can be fabricated on one carrier substrate 40. An integral antenna structure is thus formed which is suitable for devices that require multi-frequency signal transmitting/receiving capability (similar to case shown in FIG. 5(*c*)).

Figure 8:
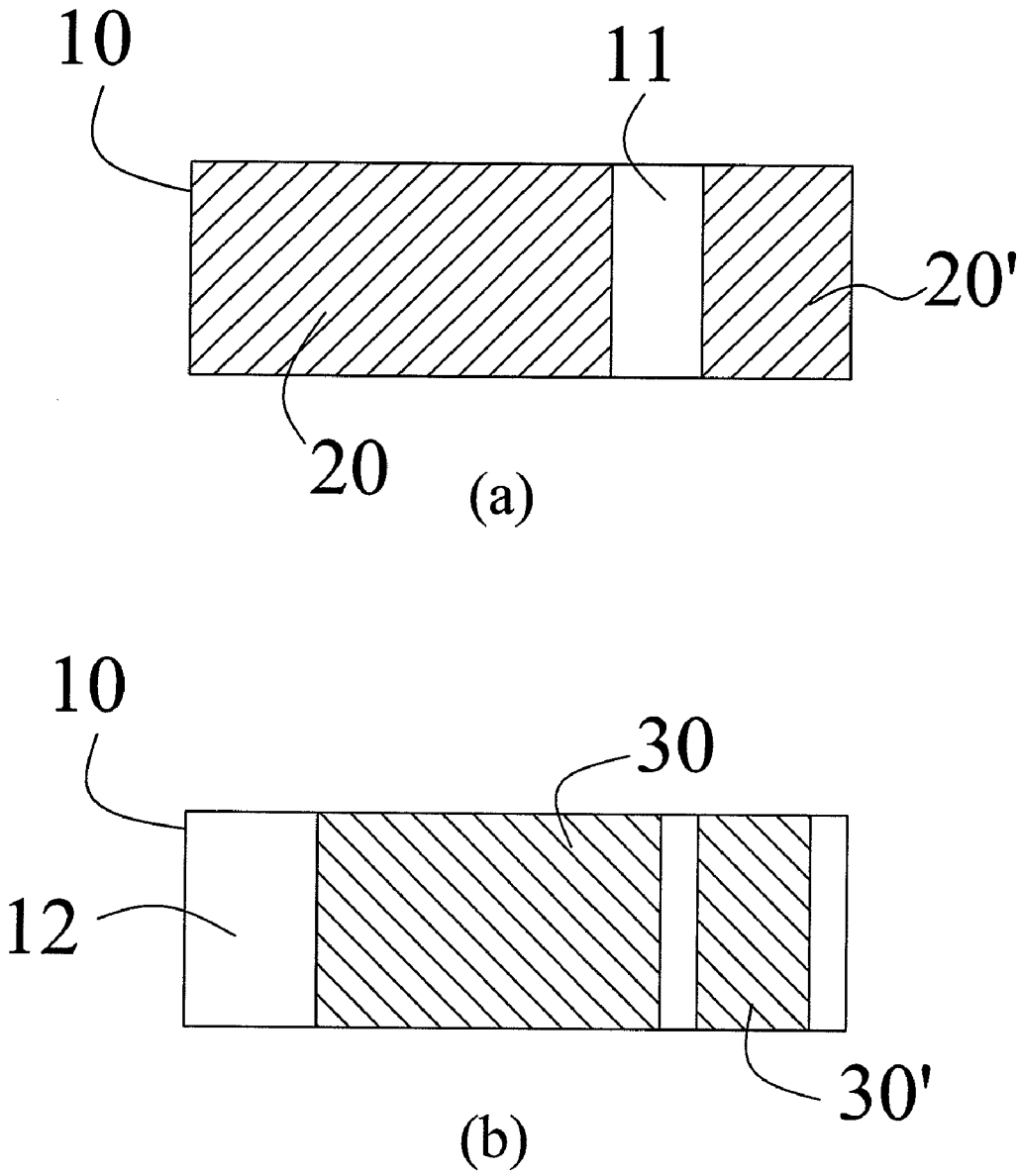
FIG. 8(*a*) is a top view schematically showing a miniature antenna according to a fifth embodiment of the present invention.
Figure 9:
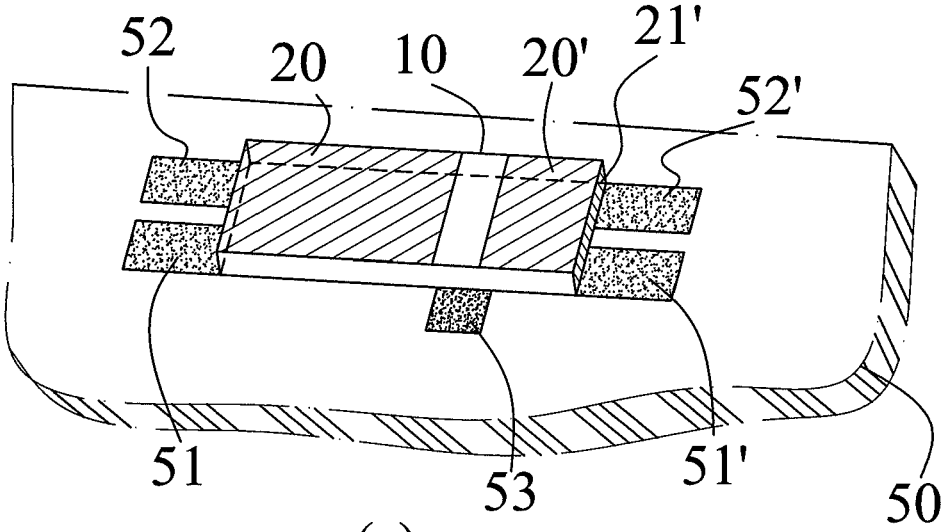
FIG. 9(*a*) is a perspective top view schematically showing the miniature antenna shown in FIG. 8(*a*) and FIG. 8(*b*) when it is integrated with a circuit board.
Figure 9:
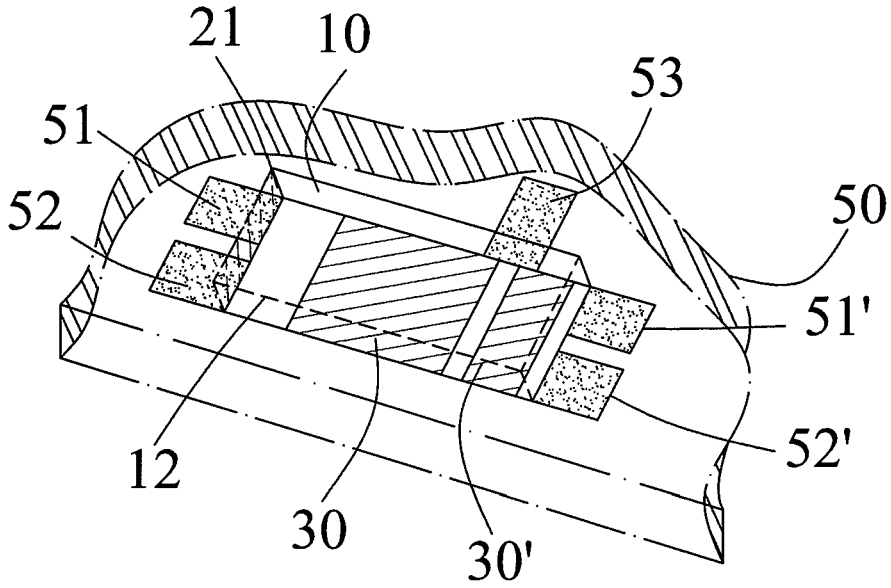

FIG. 8(*a*) and FIG. 8(*b*) illustrate a fifth embodiment of the present invention. A combo miniature antenna is fabricated according to the principles mentioned above that exhibits two resonant frequencies. In this embodiment, a miniature antenna comprises a dielectric element 10, a first surface 11, a second surface 12, two first electrode layers 20 and 20' formed on the first surface 11, and two second electrode layers 30 and 30' formed on the second surface 12, wherein the first electrode 20 partially overlaps the second electrode layer 30, and the first electrode layer 20' partially overlaps the second electrode layer 30'. The overlapping regions between the first electrode layer 20 and the second electrode layer 30 can function as a capacitor. The overlapping regions between the first electrode layer 20' and the second electrode layer 30' can also function as a capacitor. Varying the size of the electrode layers and the overlapping regions can create a combo miniature antenna having two resonant frequencies. The first electrode layer 20 and the first electrode layer 20' each extends to a end surface of the dielectric element 10 to form the first terminal electrode 21 and the first terminal electrode 21', respectively, as shown in FIG. 9(*a*) and FIG. 9(*b*). When the miniature antenna is integrated with a circuit board 50, the first terminal electrode 21 is connected with a signal feeding line 51 and a ground plane 52, and the first terminal electrode 21' is connected with a signal feeding line 51' and a ground plane 52'. The two second electrode layers 30 and 30' are connected with a ground plane 53. Thus, the miniature antenna can operate with two different frequency bands. Herein, the miniature antenna having two frequency bands is used to exemplify the present invention. However, the present invention is not limited to this embodiment and any miniature antenna based on the principles of the present invention and having more than two frequency bands is still within the scope of the present invention.

In conclusion, the present invention adopts a dielectric material as the dielectric body of a miniature antenna to create a capacitor via utilizing its physical characteristics and to confine the induced current to the proximity of the antenna, thereby effectively reduces the current loss caused by the near-field reactance effect. Also, a capacitor in series is formed at the region where the electrode layers overlap; thereby the present invention can greatly reduce the dimension of a miniature antenna while still maintaining a superior capability for signal transmitting/receiving. Furthermore, the present invention can be used to easily adjust the capacitance of a miniature antenna via varying the region formed between the first and the second electrode layers through varying the thickness of the dielectric element, varying the size of the overlapping areas of the electrode layers or varying the pattern of the electrode layers, thereby varying the resonant frequency of the miniature antenna. Therefore, the present invention provides a miniature antenna with the advantages of a simple structure, miniature in size, cost-effective, high efficiency and suitable for mass production.

While the invention has been described with reference to embodiments above, it will be recognized by those skilled in the art that various changes may be made and equivalents may be substituted for elements thereof without departing from the scope of the invention. Therefore, it is to be understood that any equivalent adaptation or variation according to the spirit of the present invention is to be also embraced within the scope of the present invention as hereinafter claimed.

What is claimed is:

1. A miniature antenna, which is connected to at least one signal feeding line and at least one ground plane and is used for transmitting and receiving signals, comprising:

at least one dielectric element made of a dielectric material, wherein the dielectric element has a first surface and a second surface opposite to said first surface;

at least one electrically conductive first electrode layer, wherein the first electrode layer is fabricated on said first surface of said dielectric element, each said first electrode layer has a first terminal electrode which is fabricated on a lateral side of said dielectric element, and said first electrode layer is connected to said signal feeding line and said ground plane through said first terminal electrode;

at least one electrically conductive second electrode layer, wherein the second electrode layer is fabricated on said second surface of said dielectric element, each said second electrode layer has a second terminal electrode which is fabricated on a lateral side of said dielectric element, and said second electrode layer is connected to said ground plane through said second terminal electrode, wherein each said first electrode layer partially overlaps said second electrode layer.

2. The miniature antenna according to claim 1, wherein said dielectric element is made of a ceramic material, a glass material, a magnetic material, a polymeric material, or a composite of said materials.

3. The miniature antenna according to claim 1, wherein said first electrode layer and said second electrode layer are made of a metallic material or an electrically conductive non-metallic material.

4. The miniature antenna according to claim 1, wherein each said first electrode layer and each said second electrode layer are fabricated on one said first surface and one said second surface respectively with a thick film process or a thin film process.

5. The miniature antenna according to claim 1, wherein said first electrode layer and said second electrode layer are established via adhering electrically conductive films onto said first surface and said second surface; respectively.

6. The miniature antenna according to claim 1, wherein a portion of said first electrode layer or a portion of said second electrode layer is fabricated to have a serpentine shape.

7. The miniature antenna according to claim 1, further comprising a carrier substrate, wherein said second electrode layer is adhered onto said carrier substrate, and said dielectric element and said first electrode layer are thereafter laid on said second electrode layer and said carrier substrate.

8. The miniature antenna according to claim 7, wherein said second electrode layer is fabricated on said carrier substrate using a thick film process or a thin film process, or adhering an electrically conductive film on said carrier substrate.

9. The miniature antenna according to claim 7, wherein two terminal electrodes are fabricated on two lateral sides of said carrier substrate for connections to said signal feeding line and said ground plane, having one said terminal electrode connected with said first electrode layer and the other said terminal electrode connected with said second electrode layer.

10. A miniature antenna for signal transmitting and receiving, which is connected to at least one signal feeding line and at least one ground plane, comprising a carrier substrate;

a plurality of electrically conductive second electrode layers being laid on said carrier substrate for connecting said ground plane;

a plurality of dielectric elements made of a dielectric material, said dielectric elements each comprising a first surface and a second surface opposite to said first surface, wherein each said second surface of said dielectric elements is disposed on one of said second electrode layers and said carrier substrate; and a plurality of electrically conductive first electrode layers being established individually on said first surfaces of said dielectric elements, wherein each said first electrode layer partially overlaps said second electrode layers, and each of said first electrode layers is connected to one said signal feeding line.

11. The miniature antenna according to claim 10, wherein each of said first electrode layers has a first terminal electrode connected to one said signal feeding line; each of said second electrode layers has a second terminal electrode connected to one said ground plane.

12. The miniature antenna according to claim 11, wherein said first terminal electrode is connected to one said signal feeding line and one said ground plane.

13. The miniature antenna according to claim 10, wherein said dielectric elements are made of a ceramic material, a glass material, a magnetic material, a polymeric material, or a composite of said materials.

14. The miniature antenna according to claim 10, wherein said first electrode layers and said second electrode layers are made of a metallic material or an electrically conductive non-metallic material.

15. The miniature antenna according to claim 10, wherein said second electrode layers are fabricated on said carrier substrate using a thick film process, a thin film process or an adhesive method; said dielectric elements are fabricated on said second electrode layers and said carrier substrate using a thick film process, a thin film process or by adhering a dielectric material on the said second electrode.

16. The miniature antenna according to claim 10, wherein said first electrode layers are fabricated on said dielectric elements and said carrier substrate using a thick film process, a thin film process or by adhering a conductive layer on said dielectric elements and said carrier substrate.

17. The miniature antenna according to claim 10, wherein said carrier substrate is made of a ceramic material, a glass material, a magnetic material, a polymeric material, or a composite of said materials.

18. A miniature antenna, which is connected to at least one signal feeding line and at least one ground plane and is used for transmitting and receiving signals, comprising:

at least one dielectric element made of a dielectric material, wherein the dielectric element has a first surface and a second surface opposite to said first surface;

at least one electrically conductive first electrode layer, wherein the first electrode layer is fabricated on said first surface of said dielectric element and is connected to said signal feeding line;

at least one electrically conductive second electrode layer, wherein the second electrode layer is fabricated on said second surface of said dielectric element and is connected to said ground plane, wherein each said first electrode layer partially overlaps said second electrode layer;

and a carrier substrate, wherein said second electrode layer is adhered onto said carrier substrate, and said dielectric element and said first electrode layer are thereafter laid on said second electrode layer and said carrier substrate.

19. The miniature antenna according to claim 18, wherein said second electrode layer is fabricated on said carrier substrate using a thick film process or a thin film process, or adhering an electrically conductive film on said carrier substrate.

20. The miniature antenna according to claim 18, wherein two terminal electrodes are fabricated on two lateral sides of said carrier substrate for connections to said signal feeding line and said ground plane, having one said terminal electrode connected with said first electrode layer and the other said terminal electrode connected with said second electrode layer.

* * * * *